United States Patent [19]

Kamimura et al.

[11] Patent Number: 5,007,327

[45] Date of Patent: Apr. 16, 1991

[54] SERVO ACTUATOR

[75] Inventors: Toshio Kamimura; Shigeyuki Takagi, both of Gifu, Japan

[73] Assignee: Teijin Seiki Company Limited, Osaka, Japan

[21] Appl. No.: 404,566

[22] Filed: Sep. 8, 1989

[30] Foreign Application Priority Data

Sep. 9, 1988 [JP] Japan ..... 63-225897

[51] Int. Cl.[5] ..... F15B 11/08

[52] U.S. Cl. ..... 91/422; 91/399; 91/440; 91/1; 92/8

[58] Field of Search ..... 91/1, 169, 399, 401, 91/422, 440, 222

[56] References Cited

U.S. PATENT DOCUMENTS

| | | | |
|---|---|---|---|
| 2,755,777 | 7/1956 | Gerwig et al. | 91/422 |
| 3,118,349 | 1/1964 | Combs | 91/422 |
| 3,447,424 | 6/1969 | Billings | 91/422 |
| 4,041,840 | 8/1977 | Zirps | 91/422 |
| 4,386,552 | 6/1983 | Foxwell | 91/1 |
| 4,809,587 | 3/1989 | Kawahara et al. | 91/422 |

FOREIGN PATENT DOCUMENTS

| | | | |
|---|---|---|---|
| 558505 | 7/1957 | Belgium | 91/422 |
| 1942816 | 3/1970 | Fed. Rep. of Germany | 91/422 |
| 1946808 | 3/1970 | Fed. Rep. of Germany | 91/422 |
| 2022609 | 11/1971 | Fed. Rep. of Germany | 91/422 |
| 1086538 | 2/1955 | France | 91/422 |
| 0171135 | 10/1982 | Japan | 91/422 |

*Primary Examiner*—Edward K. Look
*Assistant Examiner*—Thomas Denion
*Attorney, Agent, or Firm*—Finnegan, Henderson, Farabow, Garrett, and Dunner

[57] ABSTRACT

A hydraulic servo actuator adapted to control a driven member in accordance with an operation of a servo circuit through which servo oil flows comprises a main cylinder and an associated piston, associated piston being reciprocable within the cylinder and the main cylinder divided by the piston into a first chamber and a second chamber which are adapted to be in fluid communication with the servo oil, a damper means provided within the main piston for dampening reciprocating movement of the main piston. A hydraulic servo actuator also includes a throttle means for imparting a predetermined restriction to the servo oil that flows between the second chamber and the damper means along the predetermined passage formed within the cylinder.

7 Claims, 3 Drawing Sheets

SERVO ACTUATOR

BACKGROUND OF THE INVENTION

1. Field of the Invention

This invention relates to a servo actuator having a damper function.

2. Prior Art

A conventional servo actuator is used, for example, for driving a movable wing of an aircraft. FIG. 5 shows a known servo circuit 2 incorporating such a servo actuator 1. In FIG. 5, a servo valve 3 of the nozzle flapper type controls the movement of a piston 4 of the servo actuator 1. Provided between the servo valve 3 and the servo actuator 1 is a stability compensation mechanism 5 which serves to restrain a pressure variation within the servo actuator 1 so as to stabilize the servo circuit 2. The stability compensation mechanism 5 comprises a pressure differentiating piston 6, a fixed throttle 7 and a leakage valve 8. With this mechanism 5, when the pressure within the servo actuator 1 abruptly increases as a result of the inputting of an abruptly changing signal, such as a step signal, into the servo circuit 2, a pressure differential across the fixed throttle 7 is detected so as to open the leakage valve 8, thereby causing the high pressure servo oil to slightly escape to the lower pressure side so as to achieve the stabilization of the servo circuit 2.

The servo circuit 2 employs the fixed throttle 7 (which functions as a differentiating mechanism) having a constant or fixed area of opening, and therefore when the air included in the operating oil passes through the fixed throttle 7, an error signal of an extremely large value is produced, thus failing to provide a high reliability. Further, the relation between the pressure differential p across the fixed throttle 7 and the flow rate Q of the fixed throttle 7 is non-linear. In other words, the flow rate Q is proportional to the value obtained by multiplying ½ square of the pressure differential p by the area of opening of the fixed throttle 7. Therefore when the value of the above-mentioned input step signal is varied, the attenuation characteristics of the vibration, such for example as the shape of the step response curve, are greatly varied. This results in a problem that the dynamic characteristics of the servo circuit 2 are greatly varied. In addition, since the servo circuit 2 is so designed as to relieve the high pressure servo oil through the leakage valve 8, there is encountered a problem that a fluid loss develops. Further, since this system need the three component parts, that is, the pressure differentiating piston 6, the fixed throttle 7 and the leakage valve 8, the construction is complicated, and therefore the overall construction of the servo circuit 2 is bulky or large-sized, which results in an increased cost of the servo circuit.

SUMMARY OF THE INVENTION

It is therefore an object of this invention to provide a servo actuator of the type which is highly reliable in operation, and prevents the dynamic characteristics of a servo circuit from varying so much even when the value of an input signal varies in frequency characteristics, and prevents a fluid loss, and is simple and compact in construction, and is inexpensive.

According to the present invention, there is provided a servo actuator wherein an associated piston is received in a main cylinder, the associated piston is reciprocable within the main cylinder and the main cylinder is divided by the piston into a first chamber and a second chamber which are adapted to be in fluid communication with the servo circuit; damper means is provided within the main piston so as to dampen reciprocating movement of the main piston; throttle means is is imparted a predetermined restriction to the servo oil that flows between the second chamber and the damper means along a predetermined passage formed within the cylinder.

Here, let's assume that an abruptly varying signal, such as a step signal, is inputted into the servo circuit, so that a large amount of the servo oil flows, for example, into the first chamber of the servo actuator. As a result, the piston of the servo actuator begins to rapidly move. At this time, the volume of the first chamber increases because of the flow of the servo oil thereinto whereas the volume of the second chamber decreases as a result of the movement of the piston. Also, like the first chamber, the damper chamber increases in volume. As a result, the oil in the second chamber flows into the damper chamber through the passage means. At this time, since this oil passes through the throttle valve, the internal pressure of the second chamber increases, so that a pressure differential develops between the second chamber and the damper chamber. This pressure differential acts on the piston as a fluid force to thereby restrain the rapid movement of the piston. Here, if the area of opening of the throttle valve provided in the passage means is constant, the relation between the pressure differential and the flow rate is non-linear (that is, the flow rate is proportional to the value obtained by multiplying ½ square of the pressure differential by the constant area of opening), as is the case with the prior art. In this case, as the pressure differential increases, the increase in the flow rate becomes gentle. In the present invention, however, the throttle valve provided in the passage means is of such a type that the area of opening of the throttle valve increases in accordance with an increase in the pressure differential. Therefore, the flow rate increases by an amount corresponding to the increase in the area of opening of the throttle valve, so that the relation between the pressure differential and the flow rate more approximates to a linear relation (i.e., direct proportional relation) than in the prior art in which such area of opening is constant or fixed. As a result, the relation between the speed of movement of the piston and the attenuation force also approximates to a linear form, and therefore even if the value of the input signal is varied, the dynamic characteristics of the servo circuit are not varied so much. As a result, the effect of restraining the movement of the piston can be kept at an almost constant level irrespective of the variation in the input signal value. Further, in the present invention, although the throttle valve is used, this throttle valve does not function as a differentiating mechanism, and therefore the influence by the air included in the operating oil can be neglected, thus enhancing the reliability. Further, since there is no need to cause the high pressure servo oil to escape to the lower pressure side in order to restrain the movement of the piston, a fluid loss will not develop. Still further, since all that is required is to provide the throttle valve on the piston, the construction is simple, and the overall structure of the circuit can be compact in size and inexpensive.

DETAILED DESCRIPTION OF THE PREFERRED EMBODIMENTS

The invention will now be described with reference to the drawings.

Figure 1:
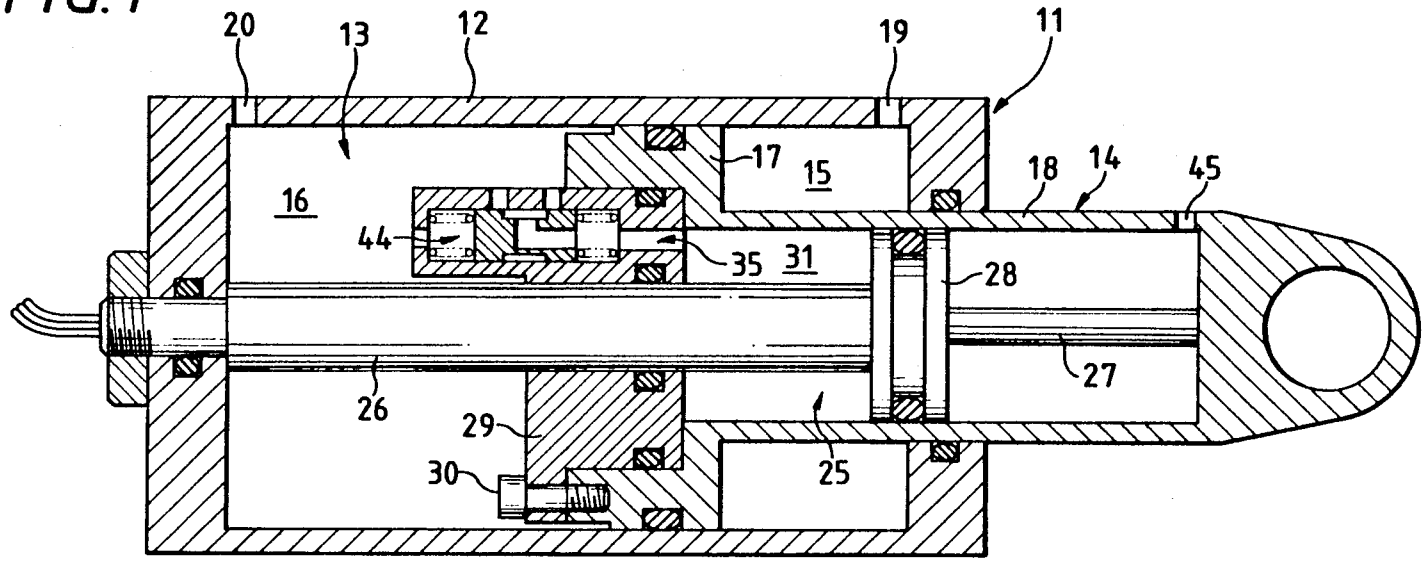
FIG. 1 is a cross-sectional view of a servo actuator provided in accordance with the present invention.

FIG. 1 shows a servo actuator 11 provided in a servo circuit. The servo actuator 11 comprises a cylinder 12 whose interior or bore defines a chamber 13, and a piston 14 received in the chamber 13 so as to be slidingly movable along the axis of the cylinder 12. The piston 14 has a piston portion 17 which divides the chamber 13 into a first chamber 15 and a second chamber 16, and a rod portion 18 formed integrally with the piston portion 17 and extending outwardly through one end wall of the cylinder 12. For example, the cylinder 12 of the servo actuator 11 is connected to the body of an aircraft whereas the rod portion 18 is connected at its distal end to a movable wing of the aircraft. An inlet/-outlet port 19 is formed through the peripheral wall of the cylinder 12 adjacent to the one end wall of the cylinder 12, the inlet/outlet port 19 communicating with the first chamber 15. Also, another inlet/outlet port 20 is formed through the peripheral wall of the cylinder 12 adjacent to the other end wall of the cylinder 12, the inlet/outlet port 20 communicating with the second chamber 16. The two inlet/outlet ports 19 and 20 are connected to a servo valve (not shown), and by switching this servo valve, servo oil is supplied to or discharged from the first chamber 15 or the second chamber 16 through the port 19 or the port 20. When the servo oil is supplied to the first chamber 15 with the servo oil discharged from the second chamber 16, the piston 14 is moved in one direction along the axis of the cylinder 12, so that the volume of the first chamber 15 increases with the volume of the second chamber 16 decreasing. Similarly, when the servo oil is supplied to the second chamber 16 with the servo oil discharged from the first chamber 15, the piston 14 is moved in the other direction along the axis of the cylinder 12, so that the volume of the second chamber 16 increases with the volume of the first chamber 15 decreasing.

The piston 14 has an internal space 25, and a detection rod 26 is received in the chamber 13 and is fixedly secured at its one or proximal end to the other end wall of the cylinder 12, the detection rod 26 constituting part of the cylinder 12. The detection rod 26 extends toward the one end wall of the cylinder 12 along the axis thereof in such a manner that the distal end portion of the detection rod 26 is received in the space 25. The piston 14 has an insertion rod 27 formed integrally therewith, and the insertion rod 27 is inserted into the detection rod 26 coaxially therewith. The detection rod 27 detects the position of the piston 14 by detecting the amount of insertion of the insertion rod 27 into the detection rod 26. A detection signal representative of such detection result is fed as a feedback signal to an adder (not shown). This adder adds this feedback signal to a set signal, and the result of this addition is fed as a control signal to the above-mentioned servo valve to control the same.

The detection rod 26 has a piston portion 28 formed on the distal end thereof, and the piston portion 28 is received in the space 25 in sliding contact with the inner surface of the space 25. A block 29 is fixedly mounted on the piston portion 17 by a bolt 30, the block 29 constituting part of the piston 14 and closing an open end of the space 25 remote from the distal end of the rod portion 18. With this construction, the piston 14 has a damper chamber 31 provided therein between the block 29 and the piston portion 28, the damper chamber 31 being isolated from the first and second chambers 15 and 16. When the piston 14 is moved along the axis of the cylinder 12 in the opposite directions as described above, the volume of the damper chamber 31 increases and decreases in accordance with the increase and decrease of the volume of the first chamber 15.

Figure 2:
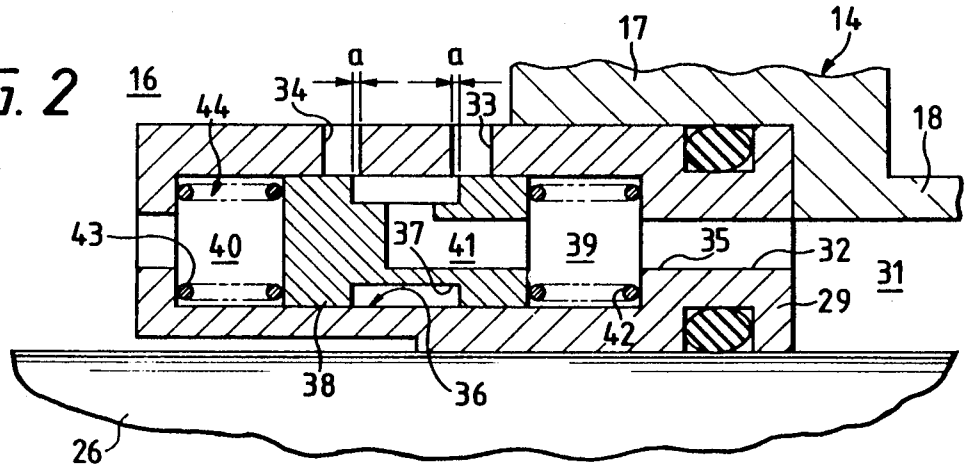
FIG. 2 is an enlarged cross-sectional view of a portion of the servo actuator in the vicinity of a throttle valve.

As best shown in FIG. 2, a passage means 35 is provided in the block 29, and the passage means 35 comprises a first passage 32 communicating with the damper chamber 31, and second and third passages 33 and 34 both communicating with the second chamber 16. Provided in the block 29 between the first passage 32 and the second and third passages 33 and 34 is a valve chamber 36 within which a spool 38 is slidably received to divide the valve chamber 36 into first and second chambers 39 and 40 disposed respectively at the opposite side portions of the block 29. The spool 38 has an annular groove 37 formed in the outer peripheral surface of the spool 38. An internal passage 41 is formed in the spool 38, and communicates at one end with the annular groove 37 and at the other end with the first chamber 39. Neutral springs 42 and 43 are accommodated within the first and second chambers 39 and 40, respectively. The two neutral springs 42 and 43 act on the opposite ends of the spool 38, respectively, to thereby hold the spool 38 in a neutral position. When the spool 38 is held in its neutral position, the opposite axial ends of the annular groove 37 respectively underlap the second and third passages 33 and 34 by the same amount of a. With this arrangement, when the spool 38 is disposed in its neutral position and during the time when the spool 38 is moved from its neutral position by a distance of a, a throttle valve 44 is always kept open to have the same area A of opening. However, when the spool 38 is moved from its neutral position beyond the distance a, the area of opening of the throttle valve 44 increases from the value A, and the amount of this increase is in direct proportion to the amount of movement of the spool 38. The valve chamber 36, the spool 38 and the neutral springs 42 and 43 jointly constitute the throttle valve 44 provided midway in the passage means 35. When the pressure differential p between the second chamber 16 and the damper chamber 31 exceeds a predetermined pressure p, the spool 38 is moved beyond the distance a, so that the area of opening of the throttle valve 44 increases in direct proportion to the amount of movement of the spool 38. Reference numeral 45 in FIG. 1 denotes a hole formed through the peripheral wall of the rod portion 18 adjacent to its distal end.

The operation of the servo actuator 11 will now be described.

Figure 3:
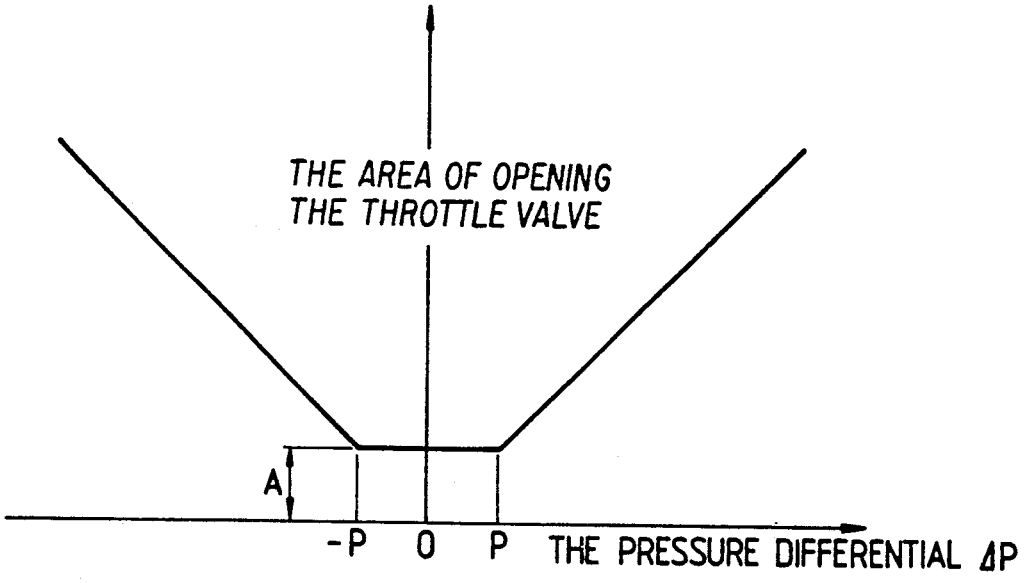
FIG. 3 is a graph illustrating the relation between a pressure differential p and the area of opening of the throttle valve.

Here, let's assume that an abruptly varying signal, such as a step signal, is inputted into the servo valve of the servo circuit, so that a large amount of the servo oil flows from the servo valve, for example, into the first chamber 15 of the servo actuator 11. As a result, the piston 14 of the servo actuator 11 begins to rapidly move toward the other end wall of the cylinder 12. At this time, the volume of the first chamber 15 increases because of the flow of the servo oil thereinto whereas the volume of the second chamber 16 decreases as a result of the movement of the piston 14. Also, like the first chamber 15, the damper chamber 31 increases in volume because of the movement of the piston 14. As a result, the oil in the second chamber 16 flows into the damper chamber 31 through the passage means 35. At this time, since this oil passes through the throttle valve 44 provided in the passage means 35, a pressure differential p develops between the second chamber 16 and the damper chamber 31 in accordance with the speed of movement of the piston 14. This pressure differential p acts on the end face of the piston 14 facing the other end wall of the cylinder 12 to thereby restrain the rapid movement of the piston 14. Here, when the spool 38 is held in its neutral position, the opposite ends of the annular groove 37 respectively underlap the second and third passages 33 and 34 by the same amount a, as described above. Therefore, during the time when the above pressure differential p increases from zero to the predetermined pressure p so that the spool 38 is moved from its neutral position by the distance a, the area of opening of the throttle valve 44 always has the constant value A, as shown in FIG. 3. Therefore, if the pressure differential p is less than the predetermined pressure p, the relation between the pressure differential p and the flow rate Q is non-linear. More specifically, the value obtained by multiplying ½ square of the pressure differential p by the above same area A of opening is in direct proportion to the flow rate Q. This is expressed by the following formula:

$$Q = A \times c \times p^{\frac{1}{2}}$$

where c represents the constant of proportionality.

Thus, during the time when the pressure differential p, is small and less than the predetermined pressure p, the above-mentioned ½ square does not have a great influence, and therefore the pressure differential p and the flow rate Q are in generally direct proportion (i.e., generally linear relation). On the other hand, when the pressure differential p exceeds the predetermined pressure p, the above-mentioned ½ square comes to have a greater influence, the flow rate Q increases gently with the increase of the pressure differential p, so that the relation between the two greatly deviates from the direct proportional relation. In this embodiment, however, when the pressure differential p exceeds the predetermined pressure p, the spool 38 of the throttle valve 44 moves beyond the distance a, so that the area of opening of the throttle valve increases in direct proportion to the increase of the pressure differential p, as shown in FIG. 3. Therefore, the area of opening of the throttle valve 44 after the pressure differential p exceeds the predetermined pressure p is the sum of the above-mentioned constant value A and the value (area) B obtained as a result of increase of the pressure differential p beyond the predetermined pressure p. Here assuming that the inclination of an inclined straight line shown in FIG. 3 is represented by b, the value of the area B of opening additionally obtained is obtained by multiplying the inclination b by the pressure differential p. Therefore, the flow rate of the oil passing through the throttle valve 44 after the pressure differential p exceeds the predetermined pressure p is represented by the following formula:

$$\begin{aligned} Q &= c \times (A + B) \times p^{\frac{1}{2}} \\ &= c \times (A + b \times p) \times p^{\frac{1}{2}} \\ &= c \times A \times p^{\frac{1}{2}} + c \times b \times p^{3/2} \end{aligned}$$

where c represents the constant of proportionality.

Figure 4:
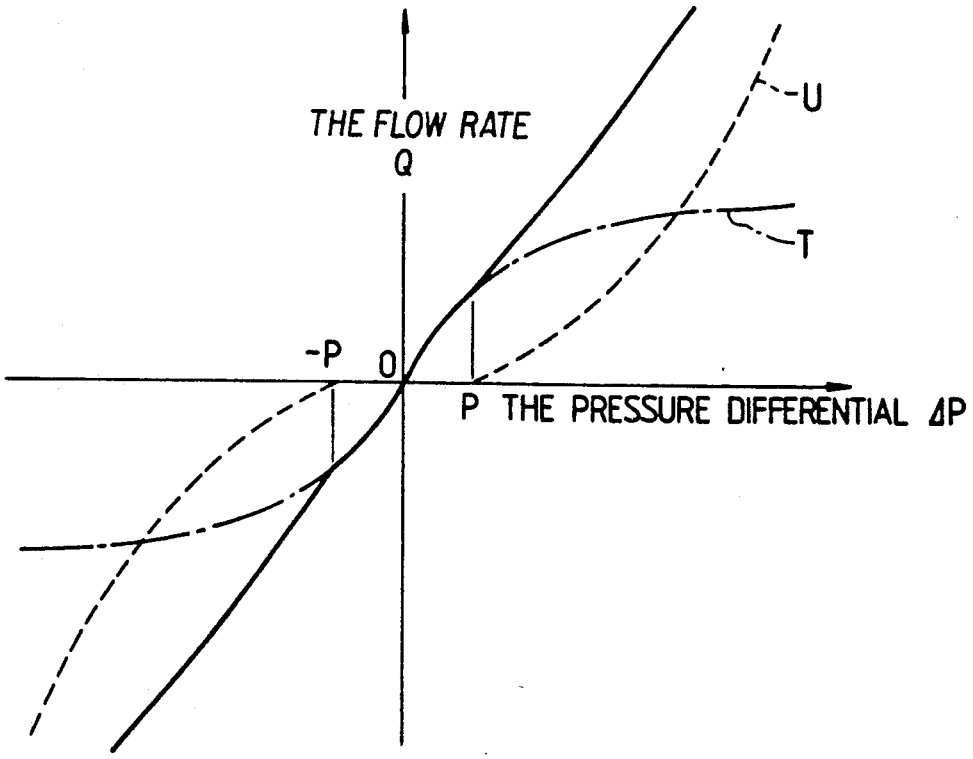
FIG. 4 is a graph illustrating the relation between the pressure differential p and the flow rate Q of the throttle valve.
Figure 5:
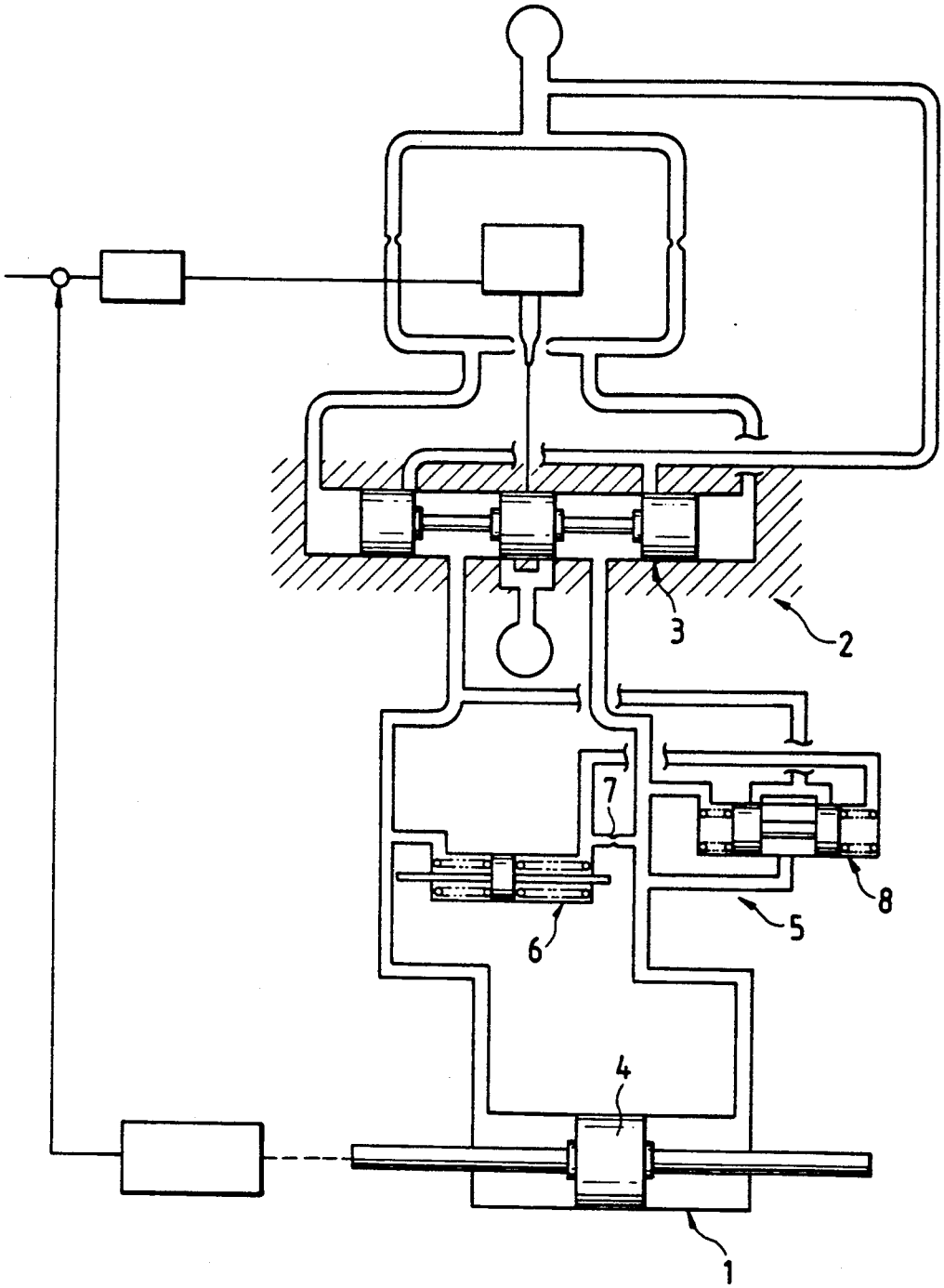
FIG. 5 PRIOR ART
FIG. 5 is a partly cross-sectional, schematic view of the conventional servo circuit.

The front half of the right side of the above formula is represented by a dot-and-dash curved line T shown in FIG. 4, and the rear half of the right side of the formula is represented by a broken curved line U in FIG. 4. What is composed by the two curved lines T and U indicates the relation between the actual flow rate Q and the pressure differential p. Here, by suitably selecting the value of the constant multiplied by p, the relation between the flow rate Q and the differential pressure p can be approximated to a linear form as indicated in a solid line in FIG. 4. As described above, if the throttle valve 44 is so designed that the area of opening of the throttle valve 44 is kept to the constant value A until the pressure differential p reaches the predetermined pressure p, and that the area of opening of the throttle valve 44 increases in direct proportion to the increase of the pressure differential p after the differential pressure p exceeds the predetermined pressure p, then the relation between the flow rate Q and the pressure differential p can be easily approximated to a linear form. As a result, the relation between the speed of movement of the piston 14 and the attenuation force is also approximated to a linear form, and therefore even if the value of the input signal is varied, the dynamic characteristics of the servo circuit are not varied so much. As a result, the effect of restraining the movement of the piston 14 can be kept at an almost constant level irrespective of the variation in the input signal value.

Further, in the present invention, although the throttle valve is used, this throttle valve does not function as a differentiating mechanism, and therefore the influence by the air included in the operating oil can be neglected, thus enhancing the reliability. Further, in this embodiment, since there is no need to cause the high pressure servo oil to escape to the lower pressure side in order to restrain the movement of the piston 14, a fluid loss will not develop. Further, all that is required is to provide the throttle valve 44 on the piston 14. Therefore, the construction is simple, and the overall structure of the circuit can be compact and inexpensive. In contrast with the above-mentioned situation, when a large amount of the servo oil flows into the second chamber 16 of the servo actuator so that the piston 14 of the servo actuator 14 begins to rapidly move toward the one end wall of the cylinder 12, the servo actuator 11 functions in a manner similar to that described above, to thereby restrain the rapid movement of the piston.

Although the throttle valve 44 used in the above embodiment is of such a type that its area of opening is kept at the constant value A until the pressure differential p reaches the predetermined pressure p and that this area of opening increases in direct proportion to the pressure differential p after the pressure differential p exceeds the predetermined pressure p, this throttle valve 44 may be replaced by another type of throttle valve whose area of opening is zero (that is, the valve is in a zero lap condition) when the pressure differential p is zero, and increases in accordance with the increase of the pressure differential p in such a manner that the flow rate Q is in direct proportion to the pressure differential p (that is, the two are in linear relation). In this case, a notch is formed in the outer peripheral surface of a spool of said another type of throttle valve in such a manner that its area of opening increases progressively toward the mid point of the spool in its axial direction.

As described above, the servo actuator according to the present invention is highly reliable in operation, and even when the value of the input signal varies in frequency characteristics, the dynamic characteristics of the servo circuit can be kept generally constant. Further, the servo actuator prevents the development of a fluid loss, and can be compact in size and inexpensive.

What is claimed is:

1. A hydraulic servo actuator adapted to control a driven member in accordance with an operation of a servo circuit through which servo oil flows, comprising:

a main cylinder and an associated main piston, said main piston being reciprocable within said cylinder and said main cylinder divided by said piston into a first chamber and a second chamber which are adapted to be in fluid communication with said servo circuit;

damper means provided within said main piston for dampening reciprocating movement of said main piston, said damper means having a sub piston and a detecting rod coupled at one end to said sub piston and at the other end to said main cylinder for defining a damper chamber in association with said main piston, and throttle means for imparting a predetermined restriction to the servo oil that flows between said second chamber and said damper means along a predetermined passage formed within said piston.

2. A hydraulic servo actuator according to claim 1, wherein an opening area of said throttle means is kept constant when a pressure difference between said second chamber and said damper chamber is smaller than a predetermined level, and said opening area increases in direct proportion to said pressure difference when said pressure difference exceeds said predetermined level.

3. A hydraulic servo actuator according to claim 2, wherein said opening area of said throttle means is at zero when said pressure difference is at zero, and said opening area increases in direct proportion to the increase of said pressure difference.

4. A hydraulic servo actuator according to claim 1, wherein said throttle means includes:

a block having a first passage, a second passage and a third passage;

a spool reciprocable within said block means, said spool imparting a predetermined restriction to said servo oil that flows between said second chamber and said damper chamber along a predetermined passage formed within said spool;

neutral spring means provided at opposite ends of said spool for holding said spool in a neutral position.

5. A hydraulic servo actuator according to claim 4, wherein said spool having an annular groove formed in a peripheral surface of said spool, an opposite axial ends of said annular groove respectively underlapping said second passage and said third passage by the same amount of area.

6. A hydraulic servo actuator wherein a piston is received in a cylinder for movement therealong, comprising:

a first chamber and a second chamber which are isolated from each other provided within said cylinder;

a servo oil flowing into and out of said first and second chambers so as to move said piston along said cylinder so that the volume of said first chamber increases and decreases whereas the volume of said second chamber decreases and increases in accordance with the increase and decrease of the volume of said first chamber;

a damper chamber provided within said cylinder which is isolated from said first chamber and said second chamber;

said servo oil flowing into and out of said damper chamber when said piston moves so that the volume of said damper increases and decreases in accordance with the increase and decrease of the volume of said first chamber;

passage means provided in said piston for communicating said second chamber with said damper chamber;

spool means reciprocable in said passage means for imparting a predetermined restriction to the servo oil flow; and throttle valve provided in said passage means, the opening area of said throttle valve increasing or decreasing in direct proportion with an increase or decrease of a pressure difference between said second chamber and said damper chamber.

7. A hydraulic servo actuator adapted to control a driven member in accordance with an operation of a servo circuit through which servo oil flows, comprising:

a main cylinder and an associated main piston, said main piston being reciprocable within said cylinder and said main cylinder divided by said piston into a first chamber and a second chamber which are adapted to be in fluid communication with said servo circuit;

damper means provided within said main piston for dampening reciprocating movement of said main piston, said damper means being fluidly isolated from said first chamber; and throttle means imparting a predetermined restriction to the servo oil that flows between said second chamber and said damper means along a predetermined passage formed within said piston, said throttle means being fluidly isolated from said first chamber.

* * * * *

UNITED STATES PATENT AND TRADEMARK OFFICE

CERTIFICATE OF CORRECTION

PATENT NO. : 5,007,327

DATED : April 16, 1991

INVENTOR(S) : Toshio Kamimura et al.

It is certified that error appears in the above-identified patent and that said Letters Patent is hereby corrected as shown below:

Claim 5, Column 8, Line 6, before "opposite" change "an" to --and--.

Signed and Sealed this

Fifteenth Day of December, 1992

*Attest:*

DOUGLAS B. COMER

*Attesting Officer*

*Acting Commissioner of Patents and Trademarks*